US009245676B2

(12) United States Patent
Koeda et al.

(10) Patent No.: US 9,245,676 B2
(45) Date of Patent: Jan. 26, 2016

(54) SOFT MAGNETIC ALLOY POWDER, COMPACT, POWDER MAGNETIC CORE, AND MAGNETIC ELEMENT

(71) Applicant: TDK CORPORATION, Tokyo (JP)

(72) Inventors: Masahito Koeda, Tokyo (JP); Yoshihiro Shinkai, Tokyo (JP); Tomofumi Kuroda, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 13/687,072

(22) Filed: Nov. 28, 2012

(65) Prior Publication Data

US 2013/0265127 A1 Oct. 10, 2013

(30) Foreign Application Priority Data

Dec. 16, 2011 (JP) ..... 2011-276171
Oct. 15, 2012 (JP) ..... 2012-227894

(51) Int. Cl.

| | |
|---|---|
| ***H01F 27/02*** | (2006.01) |
| ***H01F 5/00*** | (2006.01) |
| ***H01F 27/28*** | (2006.01) |
| ***H01F 7/02*** | (2006.01) |
| ***H01F 1/20*** | (2006.01) |
| ***H01F 1/24*** | (2006.01) |
| ***H01F 1/147*** | (2006.01) |
| ***H01F 1/26*** | (2006.01) |
| ***H01F 3/08*** | (2006.01) |

(52) U.S. Cl.

CPC ..... *H01F 7/02* (2013.01); *H01F 1/14733* (2013.01); *H01F 1/20* (2013.01); *H01F 1/24* (2013.01); *H01F 1/26* (2013.01); *H01F 3/08* (2013.01)

(58) Field of Classification Search

USPC ..... 336/83, 200, 233
See application file for complete search history.

(56) References Cited

U.S. PATENT DOCUMENTS

| | | | | |
|---|---|---|---|---|
| 2002/0068007 | A1 | 6/2002 | Itoh et al. | |
| 2003/0230362 | A1 * | 12/2003 | Tajima et al. | 148/105 |
| 2004/0145442 | A1 * | 7/2004 | Matsutani et al. | 336/200 |
| 2004/0189431 | A1 * | 9/2004 | Shibata et al. | 336/83 |
| 2007/0175545 | A1 * | 8/2007 | Urata et al. | 148/304 |
| 2008/0100410 | A1 * | 5/2008 | Tomita et al. | 336/233 |
| 2010/0068512 | A1 | 3/2010 | Imaoka et al. | |
| 2010/0085140 | A1 * | 4/2010 | Tanaka et al. | 336/221 |
| 2012/0001710 | A1 * | 1/2012 | Wakabayashi et al. | 335/297 |

FOREIGN PATENT DOCUMENTS

| | | | |
|---|---|---|---|
| CN | 101669180 | A | 3/2010 |
| JP | A-63-114108 | | 5/1988 |
| JP | A-2001-23811 | | 1/2001 |
| JP | 2003257722 | A * | 9/2003 |
| JP | 2008288525 | A * | 11/2008 |
| WO | WO 2010103709 | A1 * | 9/2010 |

* cited by examiner

*Primary Examiner* — Tsz Chan
(74) *Attorney, Agent, or Firm* — Oliff PLC

(57) ABSTRACT

Provided are a soft magnetic alloy powder, a compact made from the soft magnetic alloy powder, a powder magnetic core including the compact, and a magnetic element including the powder magnetic core. The soft magnetic alloy powder contains Fe—Ni-based particles containing 38% to 48% by mass Ni, 1.0% to 15% by mass Co, and 1.2% to 10% by mass Si relative to the total mass of Fe, Ni, Co, and Si, the remainder being Fe. The Fe—Ni-based particles have an average size of more than 1 μm to less than 10 μm.

6 Claims, 2 Drawing Sheets

SOFT MAGNETIC ALLOY POWDER, COMPACT, POWDER MAGNETIC CORE, AND MAGNETIC ELEMENT

BACKGROUND OF THE INVENTION

1. Field of the Invention

The present invention relates to a soft magnetic alloy powder; a compact; a high-performance powder magnetic core for use in choke coils, inductors, and the like; and a magnetic element including the powder magnetic core.

2. Description of the Related Art

Conventionally, powder magnetic cores are generally used as a type of magnetic core for use in inductance elements and the like. An Fe-based soft magnetic metal powder which is a soft magnetic material is usually used as a material for the powder magnetic cores. The Fe-based soft magnetic metal powder contains a material having low electrical resistance and therefore has relatively high core loss even if insulation between particles is enhanced. In recent years, compact inductance elements and the like have been demanded; hence, the powder magnetic cores need to have high electrical resistance and low core loss. Therefore, conventional soft magnetic materials need to be improved. In order to increase the electrical resistance of the Fe-based soft magnetic metal powder, a technique of adding Si thereto has been proposed. However, the hardness of the Fe-based soft magnetic metal powder is increased by the addition of Si and therefore the moldability thereof is insufficient to fabricate the powder magnetic cores. This is unsuitable for practical use.

Many Fe—Ni soft magnetic alloy (so-called permalloy) powders are used as materials, other than the Fe-based soft magnetic metal powder, for the powder magnetic cores. However, the Fe—Ni soft magnetic alloy powders are insufficient to suppress the core loss at high frequency. Therefore, Japanese Unexamined Patent Application Publication No. 2001-23811 (hereinafter referred to as Patent Document 1) proposes means for adding Si, Ge, or Sn, which is a group 14 element, for the purpose of reducing the core loss of the Fe—Ni soft magnetic alloy powders. According to Patent Document 1, the addition of a predetermined amount of a group 14 element such as Si to an Fe—Ni soft magnetic alloy powder increases the electrical resistance thereof.

Japanese Unexamined Patent Application Publication No. 2002-173745 (hereinafter referred to as Patent Document 2) discloses permalloy containing Si. According to Patent Document 2, the influence of oxygen on magnetic properties can be reduced by the addition of Si, which acts as a deoxidizing component. However, Patent Document 2 describes that an excessive amount of Si is harmful to soft magnetic properties and therefore the content of Si is limited to 1% by weight or less. Patent Document 2 also describes that Co may be added to permalloy in order to increase the magnetic flux density.

Japanese Unexamined Patent Application Publication No. 63-114108 (hereinafter referred to as Patent Document 3) discloses that Cr, Si, Cu, or Co is used as an additive element in permalloy. However, the amount of the added additive element is not described therein.

Japanese Unexamined Patent Application Publication No. 2008-135674 (hereinafter referred to as Patent Document 4) disclose an Fe—Ni alloy powder in which the problem with the Fe—Ni soft magnetic alloy powder described in Patent Document 1 or 2 is improved and which contains 1% to 6% by mass Co and 1.2% to 4.5% by mass Si relative to the total mass of Fe, Ni, Co, and Si.

As proposed in Patent Document 1, the addition of a predetermined amount of Si only to the Fe—Ni soft magnetic alloy powder significantly reduces the Curie temperature (Tc) and the saturation flux density (Bs). Such a soft magnetic material is insufficient for practical use because magnetic properties of an inductance element including a powder magnetic core made of the soft magnetic material are reduced at effective operating temperature. The permalloy disclosed in Patent Document 2 is insufficient to suppress the core loss and therefore needs to be improved. Patent Document 4 describes that the problem with the Fe—Ni soft magnetic alloy powder described in Patent Document 1 or 2 can be improved using the Fe—Ni alloy powder which contains 1% to 12% by mass Co and 1.2% to 6.5% by mass Si relative to the total mass of Fe, Ni, Co, and Si. However, in recent years, compact electronic devices and high-frequency power supplies have been widely used. Therefore, inductance elements working well at a high frequency of about several megahertz are demanded. The inventors have investigated the conventional Fe—Ni soft magnetic alloy powders described these documents in detail. As a result, the inventors have found that satisfactory properties cannot be obtained in applications used at a high frequency of about several megahertz. Powder magnetic cores cause reductions in magnetic properties due to corrosion and therefore need to have high corrosion resistance.

SUMMARY OF THE INVENTION

Accordingly, the present invention has been made in view of the foregoing circumstances and it is an object of the present invention to provide an Fe—Ni alloy powder and a powder magnetic core made from the Fe—Ni alloy powder. The Fe—Ni alloy powder has low loss and high magnetic permeability at a high frequency of about several megahertz, is high in corrosion resistance, and is suitable for the fabrication of powder magnetic cores excellent in production efficiency and economic efficiency.

As a result of intensive investigations, the inventors have found that a compact made from a soft magnetic alloy powder has particularly excellent high frequency properties at about several megahertz and high corrosion resistance, leading to the completion of the present invention. The soft magnetic alloy powder contains Fe—Ni-based particles containing 38% to 48% by mass Ni, 1.0% to 15% by mass Co, and 1.2% to 10% by mass Si relative to the total mass of Fe, Ni, Co, and Si, the remainder being Fe. The Fe—Ni-based particles have an average size of more than 1 μm to less than 10 μm.

According to the present invention, the following core is obtained by the use of the soft magnetic alloy powder, which contains the Fe—Ni-based particles controlled in alloy composition and average size as described above: a powder magnetic core including a compact having low hysteresis loss, low eddy current, and high magnetic permeability at a high frequency of about several megahertz.

The content of Si in the Fe—Ni-based particles is 1.2% to 10% by mass relative to the total mass of Fe, Ni, Co, and Si. When the Si content is less than the above range, the powder magnetic core has a large loss and low corrosion resistance. When the Si content is more than the above range, the powder magnetic core has low magnetic permeability.

The content of Co in the Fe—Ni-based particles is 1.0% to 15% by mass relative to the total mass of Fe, Ni, Co, and Si. When the Co content is less than the above range, the powder magnetic core has low magnetic permeability. When the Co content is more than the above range, the powder magnetic core has a large loss.

The content of Ni in the Fe—Ni-based particles is 38% to 48% by mass relative to the total mass of Fe, Ni, Co, and Si. When the Ni content is less than the above range, the powder magnetic core has a large loss. When the Ni content is more than the above range, the powder magnetic core has low magnetic permeability.

The Fe—Ni-based particles have an average size of more than 1 μm to less than 10 μm. When the average size thereof is less than this range, the powder magnetic core has a large loss, low magnetic permeability, and poor corrosion resistance. When the average size thereof is more than this range, the powder magnetic core has a large loss.

The present invention provides a compact containing the Fe—Ni-based particles, which contain 38% to 48% by mass Ni, 1.0% to 15% by mass Co, and 1.2% to 10% by mass Si relative to the total mass of Fe, Ni, Co, and Si, the remainder being Fe. The surface of each of the Fe—Ni-based particles is partly or entirely coated with an insulator. The Fe—Ni-based particles have an average size of more than 1 μm to less than 10 μm. Since the compact contains the Fe—Ni-based particles, the compact exhibits sufficiently reduced core loss in a high frequency operation at about several megahertz and satisfactory magnetic permeability and has high corrosion resistance.

The present invention provides a powder magnetic core including a compact obtained by press-molding a mixture of the Fe—Ni-based particles, resin, and a lubricant. Furthermore, the present invention provides a magnetic element comprising the powder magnetic core. The powder magnetic core and magnetic element according to the present invention contain the Fe—Ni-based particles and therefore exhibit sufficiently reduced core loss in a high frequency operation at about several megahertz. Spaces in elements can be minimized and therefore the demand for further downsizing can be met.

According to the present invention, the following powder, compact, and element can be provided: a soft magnetic alloy powder which has low loss and high magnetic permeability at a high frequency of several megahertz, which is excellent in corrosion resistance, production efficiency, and economic efficiency, and which contains Fe—Ni-based particles; a compact containing the soft magnetic alloy powder; and a magnetic element including the compact.

DESCRIPTION OF THE PREFERRED EMBODIMENTS

Figure 1:
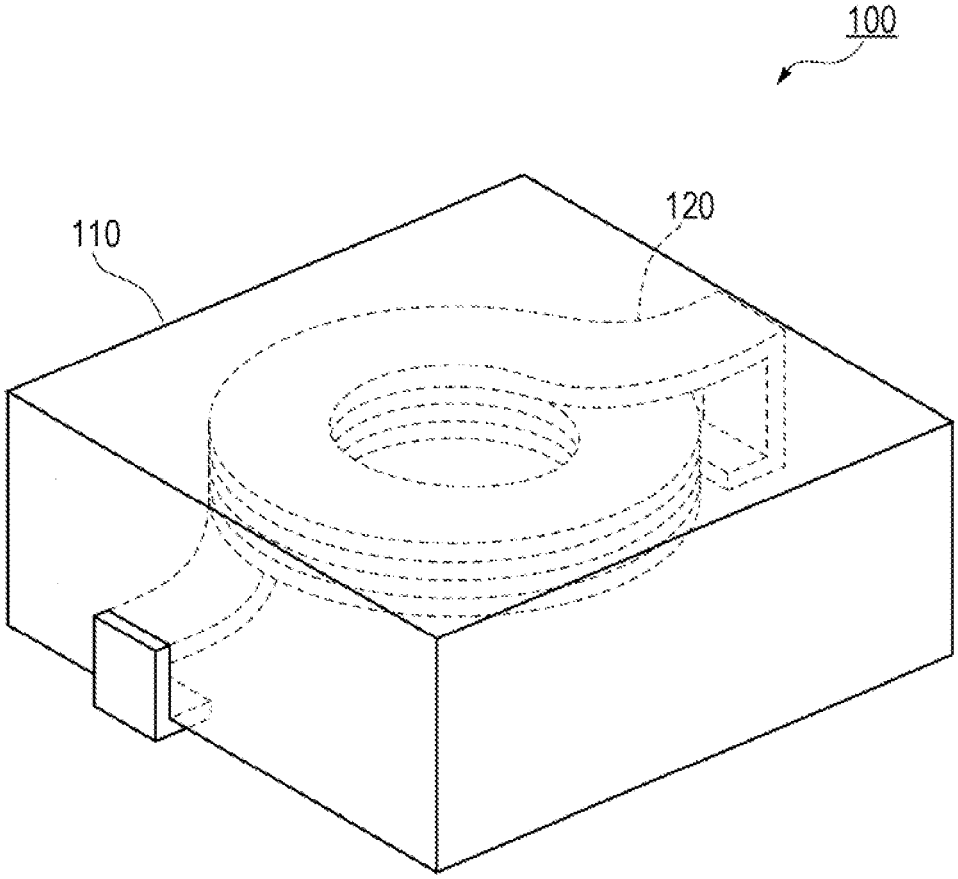
FIG. 1 is a schematic perspective view of an inductance element according to a preferred embodiment of the present invention.

Preferred embodiments of the present invention will now be described in detail with reference to the accompanying drawings as required. The same elements are denoted by the same reference numerals in the drawings and will not be described in detail. Vertical, horizontal, and other positional relations are based on those shown in the drawings unless otherwise specified. Furthermore, dimensional ratios in the drawings are not limited to those illustrated.

FIG. 1 is a schematic perspective view of an inductance element 100 according to a preferred embodiment of the present invention. With reference to FIG. 1, the inductance element 100 includes a single-piece core 110 having continuous surfaces which are perpendicular to each other to form a hexahedral shape and also includes a coil 120 which is placed in the core 110 and which has two exposed end portions.

The coil 120 includes a flat metal wire which has a rectangular shape in cross section and which is spirally wound such that a shorter side of the rectangular shape faces the center side. The end portions of the coil 120 extend from a wound portion thereof. The periphery of the coil 120 is coated with an insulating layer. The end portions of the coil 120 protrude out of vertical intermediate portions of two parallel side surfaces of the core 110. The end portions are bent from the wound portion so as to extend along the side surfaces of the core 110 and tip portions are bent so as to extend along the back surface of the core 110. The end portions of the coil 120 function as terminals and therefore are not covered by the insulating layer.

Materials for the coil 120 and the insulating layer are not particularly limited and may be those used to form a corresponding coil and insulating layer of a conventional inductance element.

The core 110 of the inductance element 100 includes a compact according to the present invention. The core 110 is a compact (press-molded body) press-molded with a die (shaping die) of a press machine which is a compression molding machine not shown. The coil 120 is precisely placed in the die prior to the formation of the core 110 and is embedded in the core 110 in association with the press molding of the core 110.

The core 110 is prepared in such a manner that an insulator is added to and mixed with Fe—Ni-based particles according to the present invention and the mixture is then pressed under predetermined conditions. In the core 110, the Fe—Ni-based particles are, therefore, coated with the insulator. It is preferred that after a soft magnetic alloy powder containing the Fe—Ni-based particles coated with the insulator is dried, a lubricant is added to and mixed with the dry soft magnetic alloy powder containing the Fe—Ni-based particles.

The content of Ni in the Fe—Ni-based particles, which are contained in the soft magnetic alloy powder according to the present invention, is 38% to 48% by mass relative to the total mass of Fe, Ni, Co, and Si. When the Ni content is less than 38% by mass, the soft magnetic alloy powder has reduced electrical resistivity and increased coercive force and therefore a powder magnetic core has increased core loss as compared to the case where the Ni content is 38% to 48% by mass. When the Ni content is more than 48% by mass, the soft magnetic alloy powder has reduced saturation magnetization and the powder magnetic core has reduced coercive force as compared to the case where the Ni content is 38% to 48% by mass. The Ni content is preferably 40% to 46% by mass and more preferably 42% to 44% by mass relative to the total mass of Fe, Ni, Co, and Si. This allows the loss and coercive force of the powder magnetic core to be further improved at high frequency.

The content of Co therein is 1.0% to 15% by mass relative to the total mass of Fe, Ni, Co, and Si. When the Co content is less than 1.0° by mass, the powder magnetic core has reduced coercive force as compared to the case where the Co content is 1.0% to 15% by mass. In contrast, when the Co content is more than 15% by mass, the soft magnetic alloy powder has increased coercive force and the powder magnetic core has increased hysteresis loss. Furthermore, the powder magnetic core is not suitable for practical use because of an increase in cost. From a similar viewpoint, the Co content is preferably 6.0% to 10% by mass relative to the total mass of Fe, Ni, Co, and Si.

The content of Si therein is 1.2% to 10% by mass relative to the total mass of Fe, Ni, Co, and Si. When the Si content is less than 1.2% by mass, the core loss is larger and the corrosion resistance is lower as compared to the case where the Si content is 1.2% to 10% by mass. In contrast, when the Si content is more than 10% by mass, the powder magnetic core is unlikely to have high density and has reduced magnetic permeability. From a similar viewpoint, the Si content is preferably 1.2% to 9.6% by mass.

The Fe—Ni-based particles according to the present invention may contain an unavoidable impurity.

The shape of the Fe—Ni-based particles according to the present invention is not particularly limited and is preferably spherical or elliptical from the viewpoint of maintaining the magnetic permeability up to high magnetic field. In particular, the shape thereof is preferably elliptical from the viewpoint of increasing the strength of the powder magnetic core.

The soft magnetic alloy powder containing the Fe—Ni-based particles according to the present invention may be one containing a single type of particles, one containing aggregates of a plurality of particles, one containing bonded particles, or one containing a mixture of these particles.

The Fe—Ni-based particles according to the present invention can be obtained by a method similar to a method of producing a known soft magnetic alloy powder. The Fe—Ni-based particles according to the present invention can be prepared by a gas atomizing method, a water atomizing method, a rotary disk method, or the like. In particular, the water atomization atomizing method is preferred because the soft magnetic alloy powder can be readily prepared so as to have desired magnetic properties and powder properties.

The surface of each of the Fe—Ni-based particles according to the present invention is partly or entirely coated with the insulator. Examples of the insulator include various organic polymer resins such as silicone resins, phenol resins, and epoxy resins and water glass. These materials may be used alone or in combination. Alternatively, these materials may be used in combination with an inorganic material such as a molding aid. The insulator preferably contains either one of an epoxy resin and a phenol resin. The use of the insulator allows the powder magnetic core to have low loss and high magnetic permeability.

The Fe—Ni-based particles according to the present invention have an average size of more than 1 μm to less than 10 μm. When the average size thereof is 1 μm or less, it is difficult to uniformly disperse a binder resin on the surface of each particle and the eddy-current loss tends to increase. Furthermore, the density of the powder magnetic core is low and the powder magnetic core is unlikely to have high magnetic permeability. When the average size thereof is 10 μm or more, the powder magnetic core has increased eddy-current loss. The soft magnetic alloy powder preferably has an average particle size of more than 2 μm to less than 8 μm and more preferably more than 3 μm to less than 6 μm. The term "average size" as used herein refers to a value obtained with a laser diffraction particle size distribution analyzer.

A magnetic element according to the present invention can be fabricated by a known method except that the powder magnetic core according to the present invention is used.

The surface of each of the Fe—Ni-based particles, which are contained in the soft magnetic alloy powder contained in the core 110, is partly or entirely coated with the insulator as described above. The insulator is appropriately selected depending on desired properties of the powder magnetic core. The amount of the added insulator varies depending on desired properties of the powder magnetic core and may be, for example, about 1% to 10% by mass of the core 110. When the amount of the added insulator is more than 10% by mass, the magnetic permeability is low and the loss tends to be large. In contrast, when the amount of the added insulator is less than 1% by mass, it is difficult to ensure insulation. The amount of the added insulator is more preferably 2.5% to 5% by mass of the core 110.

The amount of the added lubricant may be about 0.19 to 1% by mass of the core 110. The amount of the added lubricant is preferably 0.2% to 0.8% by mass and more preferably 0.3% to 0.8% by mass of the core 110. When the amount of the added lubricant is less than 0.1% by mass, demolding is difficult after molding and molding cracks tend to be caused. In contrast, when the amount of the added lubricant is more than 1% by mass, a reduction in green density is caused and the magnetic permeability is reduced. Examples of the lubricant include aluminum stearate, barium stearate, magnesium stearate, calcium stearate, zinc stearate, and strontium stearate. These stearates are used alone or in combination. In particular, the lubricant is preferably aluminum stearate because so-called springback is small.

A cross-linker may be further added to the soft magnetic alloy powder, which contains the Fe—Ni-based particles. The addition of the cross-linker allows the mechanical strength of the core 110 to be increased without deteriorating magnetic properties of the core 110. The amount of the added cross-linker is preferably 10 parts to 40 parts by mass per 100 parts by mass of the insulator. The cross-linker may be an organotitanium compound.

The inductance element 100 can be fabricated by a known method except that the soft magnetic alloy powder containing the Fe—Ni-based particles according to the present invention is used as a material for the core 110. The inductance element 100 may be fabricated through, for example, a soft magnetic alloy powder-preparing step, an insulator-coating step, a molding step, and a thermal treatment step. First, in the soft magnetic alloy powder-preparing step, the soft magnetic alloy powder, which contains the Fe—Ni-based particles, is prepared.

Next, in the insulator-coating step, a predetermined amount of the soft magnetic alloy powder is mixed with a predetermined amount of the insulator. In the case of adding the cross-linker, the cross-linker is mixed with the soft magnetic alloy powder and the insulator. A press kneader is used for mixing. Mixing is preferably performed at room temperature for 20 minutes to 60 minutes. The obtained mixture is preferably dried at about 100° C. to 300° C. for 20 minutes to 60 minutes. The dry mixture is pulverized, whereby the soft magnetic alloy powder containing the Fe—Ni-based particles coated with the insulator is obtained. Subsequently, the lubricant is added to the soft magnetic alloy powder as required. The soft magnetic alloy powder and the lubricant are preferably mixed for 10 minutes to 40 minutes.

Next, in the molding step, the coil 120 is provided at a predetermined position in a die of a press machine and the soft magnetic alloy powder containing the Fe—Ni-based particles coated with the insulator is filled in the die. The soft magnetic alloy powder is then compression-molded by pressing, whereby a molding is obtained. Conditions for compression molding are not particularly limited and may be appropriately determined depending on the shape or size of the Fe—Ni-based particles or the shape, size, or density of the powder magnetic core. For example, the maximum pressure is usually about 100 MPa to 1,000 MPa and preferably about 100 MPa to 600 MPa. The time for which the maximum pressure is held is about 0.1 second to one minute. When the molding pressure is extremely low, satisfactory properties and mechanical strength are unlikely to be achieved. In contrast, when the molding pressure is extremely high, the coil 120 is likely to short out.

Next, in the thermal treatment step, the molding obtained as described above is maintained, for example, at 150° C. to 300° C. for 15 minutes to 45 minutes. This allows resin, that is, the insulator contained in the molding to be cured, whereby the inductance element 100 is obtained. The inductance element 100 includes the core 110, which is the powder magnetic core (compact), and the coil 120.

A rust-proofing step of rust-proofing the inductance element 100 may be performed subsequently to the thermal treatment step as required. The rust-proofing step is performed in such a manner that the inductance element 100 obtained as described above is spray-coated with, for example, an epoxy resin or the like. The thickness of a layer formed by spray coating is about 15 μm. After being rust-proofed, the inductance element 100 is preferably thermally treated at 120° C. to 200° C. for 15 minutes to 45 minutes.

As described above, according to this embodiment, the core 110 mainly contains the Fe—Ni-based particles, which contain predetermined amounts of Si and Co. Therefore, the core loss of the core 110 can be sufficiently reduced particularly at a high frequency of about several megahertz. The presence of a predetermined amount of Si in the Fe—Ni-based particles is effective in promoting and maintaining soft magnetic properties of the core 110 and is also effective in enhancing the corrosion resistance thereof. Although the Fe—Ni-based particles contain Si, the core 110 has low hardness. This is a key factor to allow the moldability of a core to be good.

The core 110 can increase the magnetic permeability, principally because the Fe—Ni-based particles contain predetermined amounts of Si and Co. Thus, the core 110 has excellent soft magnetic properties.

The inductance element 100 includes the core 110, which has the above-mentioned properties, and therefore is allowed to have sufficiently low loss and high inductance density in a high frequency operation at about several megahertz. The inductance element 100 enables further downsizing as compared to conventional one and can effectively exhibit advantages thereof if being incorporated in, for example, electronic devices, such as mobile phones, operating at a high frequency of about several megahertz and various members such as power supplies, electronic circuits, substrates, and chip sets.

Preferred embodiments of the present invention have been described above. The present invention is not limited to the embodiments. Various modifications can be made within the scope of the present invention. For example, in an embodiment of the present invention, an element including a powder magnetic core according to the present invention is not limited to an inductance element and may be one of various transformers and magnetic shields. These elements may be in known forms except that a soft magnetic alloy powder according to the present invention is used as a magnetic material for use in a powder magnetic core.

In an inductance element according to the present invention, a coil need not be placed in a powder magnetic core. Such an inductance element may be one in which a powder magnetic core includes, for example, a core part (center leg) with a columnar shape, pot parts (outer legs) spaced outside the core part, and connection parts connecting the core part to the pot parts and a coil is wound around the core part.

Furthermore, an inductance element according to the present invention may include a powder magnetic core according to the present invention and is not limited to a so-called wire-wound type in which a coil is wound as described above. An inductance element according to the present invention may be, for example, a so-called multilayer type inductance element including printed conductor patterns connected to each other through via-holes instead of a wire-wound coil. Alternatively, an inductance element according to the present invention may be a so-called thin film type inductance element including a planar spiral conductor instead of such a wire-wound coil.

EXAMPLES

The present invention is further described below in detail with reference to examples. The present invention is not limited to the examples. In the examples, the content of each of Fe, Ni, Co, and Si is based on the total mass of Fe, Ni, Co, and Si.

Preparation of Soft Magnetic Alloy Powders

First prepared were ingots, chunks (lumps), or shots (particles) of an Fe—Ni alloy, Fe, Ni, Co, and Si. These materials were mixed, whereby compositions shown in Table 1 were obtained. Each composition was put in a crucible placed in a water atomizing system. The crucible was heated to 1,500° C. or higher in an inert atmosphere by high frequency induction using a work coil placed outside the crucible. The ingots, chunks, or shots in the crucible were melted and mixed, whereby a melt was obtained.

Next, the melt in the crucible was sprayed from a nozzle attached to the crucible and a high-pressure (50 MPa) water flow was applied to the sprayed melt such that the sprayed melt was quenched, whereby a soft magnetic alloy powder containing Fe—Ni-based particles was prepared.

Fabrication of Powder Magnetic Cores

An insulator, that is, an epoxy resin, N-695, available from DIC Corporation and a curing agent were added to each soft magnetic alloy powder, the amount of the epoxy resin and curing agent added thereto being 3.0% by mass of the soft magnetic alloy powder, followed by kneading at room temperature for 30 minutes in a press kneader. The kneaded product was naturally dried in air. A lubricant, that is, zinc stearate was added to the kneaded product, the amount of added zinc stearate being 0.1. % by mass of the kneaded product, followed by mixing for 10 minutes in a V-mixer. Subsequently, the obtained mixture was molded, whereby a molding having an outer diameter of 11 mm, an inner diameter of 6.5 mm, and a thickness of 2.5 mm was prepared. The molding pressure was 600 MPa. After being pressed, the molding was thermally treated at 180° C. for 60 minutes such that the epoxy resin was cured, whereby a powder magnetic core was obtained.

Evaluation Methods (1) Measurement of Content of Fe, Ni, Co, and Si in Soft Magnetic Alloy Powder The content of Fe, Ni, Co, and Si in each soft magnetic alloy powder was measured with an X-ray fluorescence (XRF) analyzer, ZXS-100E, available from Rigaku Corporation. The measurement results are shown in Table 1.

(2) Average Particle Size of Soft Magnetic Alloy Powder

The average particle size of each soft magnetic alloy powder was measured with a laser diffraction particle size analyzer, HELOS System, available from JEOL Ltd. The measurement results are shown in Table 1.

(3) Measurement of Core Loss

The obtained powder magnetic cores were measured for core loss (Pcv) with a maximum magnetic flux density Bm of 10 mT using a BH analyzer, SY-8218, available from Iwatsu Electric Co., Ltd. The core loss determined at 1.0 MHz is shown in Table 1.

(4) Measurement of Magnetic Permeability of Powder Magnetic Core

The obtained powder magnetic cores were measured for initial magnetic permeability (μ) using an LCR meter, 4285A, available from Hewlett-Packard Company. Results obtained at 10 MHz under a direct-current magnetic field of 8 kA/m are shown in Table 1.

(5) Corrosion Resistance Test

The obtained powder magnetic cores were immersed in a 5 mass percent aqueous solution of sodium chloride at room temperature and atmospheric pressure and the time of rust appearance was evaluated. Corrosion resistance test results of examples and comparative examples are shown in Table 2.

Results of the examples and the comparative examples are shown in Tables 1 and 2.

TABLE 1

| | Fe (mass percent) | Ni (mass percent) | Si (mass percent) | Co (mass percent) | Average particle size (μm) | Core loss (kW/m$^3$) | Magnetic permeability |
|---|---|---|---|---|---|---|---|
| Example 1 | 40 | 43 | 7.2 | 9.8 | 4.1 | 1352 | 20.5 |
| Example 2 | 43 | 43 | 4.8 | 9.6 | 4.3 | 1364 | 21.2 |
| Example 3 | 38 | 43 | 9.6 | 9.5 | 4.6 | 1375 | 19.5 |
| Example 4 | 43 | 43 | 7.1 | 6.6 | 4.2 | 1341 | 19.2 |
| Example 5 | 35 | 43 | 6.9 | 14.4 | 4.4 | 1361 | 23.1 |
| Example 6 | 43 | 40 | 7.1 | 9.7 | 4.3 | 1297 | 20.8 |
| Example 7 | 38 | 45 | 7.2 | 9.5 | 4.5 | 1425 | 20.1 |
| Example 8 | 40 | 43 | 7.3 | 9.7 | 2.1 | 1273 | 18.3 |
| Example 9 | 40 | 43 | 7.1 | 9.5 | 8.2 | 1526 | 21.3 |
| Example 10 | 58 | 40 | 1.2 | 1.0 | 4.3 | 1432 | 23.1 |
| Example 11 | 44 | 45 | 9.6 | 1.0 | 4.5 | 1465 | 18.7 |
| Example 12 | 41 | 43 | 1.2 | 14.6 | 4.5 | 1503 | 22.3 |
| Example 13 | 32 | 43 | 9.7 | 14.7 | 4.4 | 1464 | 21.9 |
| Example 14 | 53 | 40 | 1.1 | 6.2 | 4.4 | 1232 | 23.5 |
| Example 15 | 44 | 45 | 4.3 | 6.3 | 4.5 | 1258 | 22.5 |
| Example 16 | 46 | 43 | 1.2 | 9.8 | 4.4 | 1264 | 22.7 |
| Example 17 | 43 | 43 | 4.4 | 9.7 | 4.4 | 1245 | 21.5 |
| Comparative Example 1 | 19 | 43 | 28.5 | 9.4 | 4.8 | 3297 | 13.1 |
| Comparative Example 2 | 47 | 43 | 0.0 | 9.7 | 4.5 | 2014 | 16.6 |
| Comparative Example 3 | 24 | 43 | 7.1 | 25.8 | 4.3 | 3541 | 13.8 |
| Comparative Example 4 | 49 | 43 | 7.3 | 0.0 | 4.2 | 1864 | 11.4 |
| Comparative Example 5 | 83 | 0 | 7.3 | 9.7 | 4.3 | 2312 | 12.1 |
| Comparative Example 6 | 18 | 65 | 7.4 | 9.7 | 4.6 | 1924 | 10.8 |
| Comparative Example 7 | 100 | 0 | 0.0 | 0.0 | 4.5 | 4021 | 23.8 |
| Comparative Example 8 | 40 | 43 | 7.2 | 9.5 | 25.1 | 12377 | 24.3 |
| Comparative Example 9 | 40 | 43 | 7.1 | 9.7 | 0.5 | 2253 | 12.5 |
| Comparative Example 10 | 40 | 43 | 7.2 | 9.6 | 11.3 | 1835 | 22.1 |
| Comparative Example 11 | 49 | 40 | 10.8 | 0 | 4.3 | 2654 | 9.3 |
| Comparative Example 12 | 40 | 45 | 0 | 15.4 | 4.5 | 3501 | 14.2 |
| Comparative Example 13 | 31 | 43 | 10.6 | 15.6 | 4.5 | 5362 | 17.5 |

TABLE 2

| | Fe (mass percent) | Ni (mass percent) | Si (mass percent) | Co (mass percent) | Average particle size (μm) | Core loss (kW/m$^3$) | Magnetic permeability | Corrosion resistance (h) |
|---|---|---|---|---|---|---|---|---|
| Comparative Example 2 | 47 | 43 | 0.0 | 9.7 | 4.5 | 2014 | 16.6 | 5 |
| Example 16 | 46 | 43 | 1.2 | 9.8 | 4.4 | 1264 | 22.7 | 20 |
| Example 17 | 43 | 43 | 4.4 | 9.7 | 4.4 | 1245 | 21.5 | 25 |
| Example 2 | 43 | 43 | 4.8 | 9.6 | 4.3 | 1364 | 21.2 | 25 |
| Example 1 | 40 | 43 | 7.2 | 9.8 | 4.1 | 1352 | 20.5 | 30 |
| Example 3 | 38 | 43 | 9.6 | 9.5 | 4.6 | 1375 | 19.5 | 35 |

As is clear from Table 1, the powder magnetic cores made from the soft magnetic alloy powders containing Fe—Ni-based particles which contain 38% to 438% by mass Ni, 1.0% to 15% by mass Co, and 1.2% to 10% by mass Si relative to the total mass of Fe, Ni, Co, and Si, the remainder being Fe, and which have an average size of more than 1 μm to less than 10 μm have low loss and high magnetic permeability.

Table 2 shows magnetic properties and corrosion resistance in the case where the content of Ni and the content of Co are substantially the same as those described above and the content of Si is varied relative to the total mass of Fe, Ni, Co, and Si. As is clear from these results, high corrosion resistance is obtained when the content of Si is 1.2% by mass or more.

Thus, as is clear from Table 1, the powder magnetic cores made from the soft magnetic alloy powders containing the Fe—Ni-based particles which contain 38% to 48% by mass Ni, 1.0% to 15% by mass Co, and 1.2% to 10% by mass Si relative to the total mass of Fe, Ni, Co, and Si, the remainder being Fe, and which have an average size of more than 1 μm to less than 10 μm have low loss, high magnetic permeability, and excellent corrosion resistance.

As is clear from Comparative Examples 1 to 13, any powder magnetic core having low loss and high magnetic permeability is not obtained from those other than the Fe—Ni-based particles which contain 38% to 48% by mass Ni, 1.0% to 15% by mass Co, and 1.2% to 10% by mass Si relative to the total mass of Fe, Ni, Co, and Si, the remainder being Fe, and which have an average size of more than 1 μm to less than 10 μm.

Figure 2:
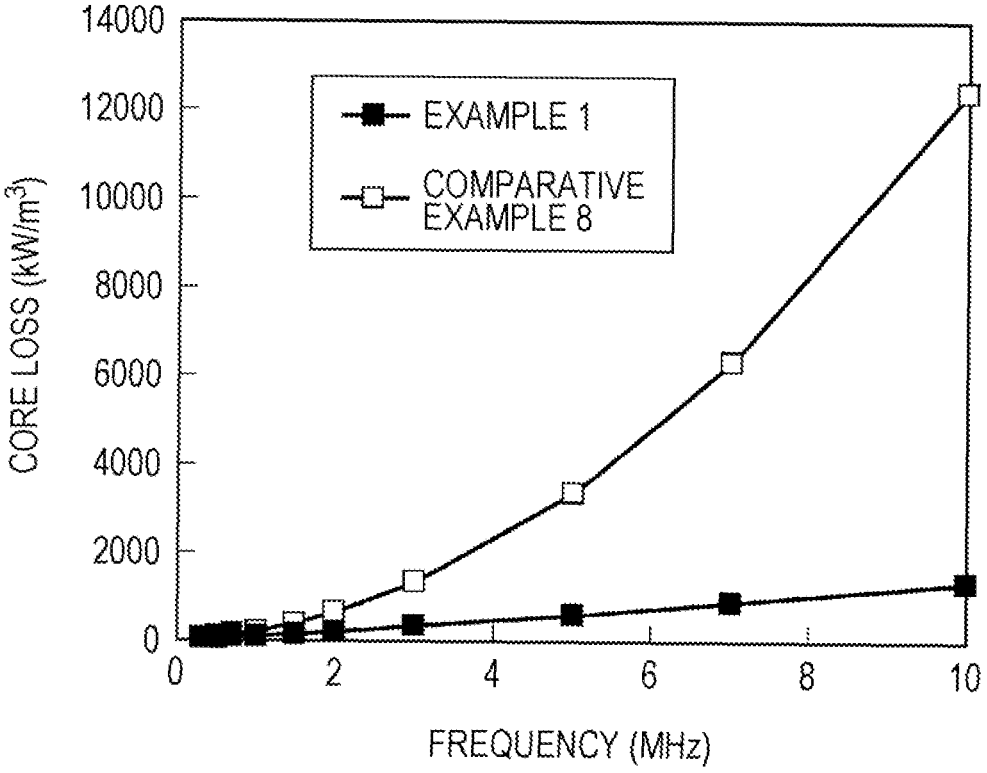
FIG. 2 is a graph showing the frequency dependence of the core loss of powder magnetic cores prepared in Example 1 and Comparative Example 8.

FIG. 2 shows the frequency dependence of the core loss of the powder magnetic cores prepared in Example 1 and Comparative Example 3. The powder magnetic core prepared from the soft magnetic alloy powder containing the Fe—Ni-based particles having an average size of 1 μm to less than 10 μm in Example 1 has core loss with slight frequency dependence. The core loss ratio of the powder magnetic core prepared in Example 1 to the powder magnetic core prepared from the soft magnetic alloy powder containing the Fe—Ni-based particles having an average size of 10 μm or more in Comparative Example 8 decreases with an increase in frequency.

A powder magnetic core according to the present invention can be widely and effectively used as a magnetic core for use in various electromagnetic devices such as choke coils, inductors, and transformers.

What is claimed is:

1. A soft magnetic alloy powder comprising Fe—Ni-based alloy particles containing 38% to 48% by mass Ni, 1.0% to 15% by mass Co, and 1.2% to 10% by mass Si relative to the total mass of Fe, Ni, Co, and Si, the remainder being Fe, wherein the Fe—Ni-based particles have an average size of more than 1 μm to less than 10 μm, and wherein the Fe—Ni-based alloy particles have a core loss of 1526 kW/m$^3$ or less at 10 MHz.

2. A powder magnetic core comprising a compact obtained by press-molding a mixture of the Fe—Ni-based alloy particles specified in claim 1, resin, and a lubricant.

3. A magnetic element comprising the powder magnetic core according to claim 2.

4. A compact comprising Fe—Ni-based alloy particles containing 38% to 48% by mass Ni, 1.0% to 15% by mass Co, and 1.2% to 10% by mass Si relative to the total mass of Fe, Ni, Co, and Si, the remainder being Fe, wherein the surface of each of the Fe—Ni-based particles is partly or entirely coated with an insulator and the Fe—Ni-based particles have an average size of more than 1 μm to less than 10 μm, and wherein the Fe—Ni-based alloy particles have a core loss of 1526 kW/m$^3$ or less at 10 MHz.

5. A powder magnetic core comprising a compact obtained by press-molding a mixture of the Fe—Ni-based alloy particles specified in claim 4, resin, and a lubricant.

6. A magnetic element comprising the powder magnetic core according to claim 5.

* * * * *